US005613756A

United States Patent [19]

Allen

[11] Patent Number: 5,613,756

[45] Date of Patent: Mar. 25, 1997

[54] CLOTHING WITH POUCH MEANS FOR RECEIVING AN ILLUMINATING DEVICE

[76] Inventor: Mary E. Allen, 17 Athlone Drive, Toronto, Ontario, Canada, M8Y 2M5

[21] Appl. No.: 517,579

[22] Filed: Aug. 21, 1995

[51] Int. Cl.[6] ..... F21L 15/08

[52] U.S. Cl. ..... 362/103; 362/84; 362/189

[58] Field of Search ..... 362/84, 103, 105, 362/106, 108, 189, 190, 191, 276; 116/202

[56] References Cited

U.S. PATENT DOCUMENTS

| | | | |
|---|---|---|---|
| 3,720,918 | 3/1973 | Perl . | |
| 4,709,307 | 11/1987 | Branom . | |
| 4,839,777 | 6/1989 | Janko et al. . | |
| 5,019,438 | 5/1991 | Rapisarda . | |
| 5,070,436 | 12/1991 | Alexander et al. . | |
| 5,073,844 | 12/1991 | Coyner et al. | 362/156 |
| 5,113,325 | 5/1992 | Eisenbraun . | |
| 5,124,892 | 6/1992 | Lambert . | |
| 5,128,843 | 7/1992 | Guritz . | |
| 5,268,827 | 12/1993 | Granneman et al. | 362/84 |
| 5,400,230 | 3/1995 | Nicoletti | 362/189 |

FOREIGN PATENT DOCUMENTS

| | | | |
|---|---|---|---|
| 335795 | 5/1972 | U.S.S.R. | 362/84 |

*Primary Examiner*—Y. My Quach

[57] ABSTRACT

A clothing with illuminating device comprises an illuminating panel, a power source electrically connected to the illuminating panel by electric wires, a switch for controlling the power supply from the power source, a sleeve for protecting and supporting the illuminating panel, a pouch with an opening for receiving the power source and the illuminating panel, the pouch adapted to be detachably mounted to the clothing, fastener for closing the pouch, a window opening provided on the pouch for permitting light signal generating from the illuminating panel to pass through when the power source is being turned on.

16 Claims, 4 Drawing Sheets

CLOTHING WITH POUCH MEANS FOR RECEIVING AN ILLUMINATING DEVICE

FIELD OF THE INVENTION

The present invention relates to a clothing and in particular, to a clothing with a pocket or a pouch for removeably receiving therein an illuminating device which generates light signal in the dark.

BACKGROUND OF THE INVENTION

A person working or performing activities at night is put in danger if the place is not illuminated by sufficient light. Illuminating means which may generate light signal at night time have been designed to be worn by people.

One proposal involves a vest with reflective material provided on the front and back of the vest. A person wears the vest over their clothing. The vest gives out reflected light when light from say a vehicle headlight is shone on the vest. However, it is not very useful in the circumstances when the environment is very dark and light is not shone on the vest. The person will still be remained in the dark and in danger.

Other proposals involve the using of an illuminating device provided in clothing. However, these illuminating devices and their ways of attachment in clothing are complicated. Furthermore, the attachment of the illuminating device in clothing is permanent.

U.S. Pat. No. 3,720,918 issued to Perl on Mar. 13, 1973 discloses a vehicle indicator belt to be worn by a vehicle operator. The belt contains indicator lights which are positioned on the belt. A power supply is also positioned on the belt. Electrical wiring is used to interconnect the indicator lights to the power supply through an activating switch. The belt contains a channel formed by the belt material for use as a housing for the electrical wiring.

One of the disadvantages of this vehicle indicator belt is that it uses light bulbs as indicator lights. These light bulbs make the belt bulky and unsafe to use. Another disadvantage is that since the belt is to be worn around the waist of the vehicle operator, the portion of the clothing near the waist of the vehicle operator is likely to cover up and block the indicator lights on the belt.

U.S. Pat. No. 5,070,436 issued to Alexander et al. on Dec. 3, 1991 shows a signal vest which is made of bright coloured materials, reflective materials, and equipped on the front and back with flashing lights, controlled by self contained electrical circuits, including a battery.

The disadvantage of this signal vest is that it is very complicated in construction, and high in manufacturing and maintenance costs. Another disadvantage is that the signal devices are not readily attachable to and removable from the vest.

U.S. Pat. No. 5,113,325 issued to Eisenbraun on May 12, 1992 discloses a light assembly kit for illuminating an article of clothing. The kit assembly includes a central actuation unit having a plurality of wires connecting the central actuation unit with a plurality of light emitting diodes. The central actuation unit has a control circuit and a power supply connected thereto via a switch. The LED's, when installed through apertures in the garment, can flash ON and OFF in a desired pattern to enhance the illumination.

Again, the assembly consisted of too many wirings and light emitting diodes making the clothing rather bulky and uncomfortable to wear. These wirings and light emitting diodes are more or less permanently installed in the clothing. Another disadvantage is that numerous apertures have to be formed on the clothing. This seriously damages the clothing.

BRIEF SUMMARY OF THE INVENTION

The present invention provides a clothing with a simple pouch means for receiving therein an illuminating device allowing same to be easily attached to and removed from the clothing.

The present invention provides a clothing with illuminating device comprising illuminating panel means, power source means electrically connected to the illuminating panel means by wire means, switch means for controlling the power supply from the power source means, sleeve means for protecting and supporting the illuminating panel means, means for holding the illuminating panel means in position within the sleeve means, pouch means with an opening for receiving the power source means and the illuminating panel means, the pouch means being detachably mounted to the clothing, means for closing the opening of the pouch means, means for holding the power source means and the sleeve means in position within the pouch means, and window means provided on the pouch means for permitting light signal generating from the illuminating panel means to pass therethrough when the power source means is being turned on.

The present invention also provides a clothing with illuminating device having a light signal means for indicating the illumination condition of the illuminating panel means.

The present invention further provides a clothing with illuminating device wherein the sleeve means for receiving and protecting the illuminating panel means is in the form of a first cover sheet provided on the front surface of the illuminating panel means and a second cover sheet provided on a rear surface of the illuminating panel means, the first and second cover sheets being sewn together along their respective edges.

The present invention further provides a clothing with illuminating device wherein the first cover sheet is made of a flexible transparent plastic material whereas the second cover sheet is in the form of a scrim for supporting the illuminating panel means in a semi-rigid condition.

The present invention further provides a clothing with illuminating device wherein one end of the pouch means is provided with an enlarged compartment for receiving therein the power source means.

The present invention further provides a clothing with illuminating device wherein the opening of the pouch means is provided along a longitudinal side of the pouch means, whereby the illuminating panel means and the power source means are adapted to be inserted into and removed from the pouch means sidewards.

The present invention further provides a clothing with illuminating device wherein the opening of the pouch means is provided on the enlarged compartment at the end of the pouch means, whereby the illuminating panel means and the power source means are adapted to be inserted into and removed from the pouch means endwise.

The present invention further provides a clothing with illuminating device wherein the pouch means is adapted to be mounted across a clothing being worn on the upper part of the body of a user such that the illuminating panel means is located at the back of the user whereas the switch means is located at the front of the user.

The present invention further provides a clothing with illuminating device wherein the pouch means is adapted to be mounted along an outer leg of a pant such that the illuminating panel means is located along the side of a leg of a user whereas the switch means is located near the waistband of the pant.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Specific embodiments of the invention will now be described by way of examples with reference to the accompanying drawings wherein.

DESCRIPTION OF A SPECIFIC EMBODIMENT

The present invention relates to a clothing with a detachable pocket or a pouch for receiving therein an illuminating device.

The clothing for use in association with the illuminating device may be a coat or a jacket worn by a ground man or a flag man working at an airport at night time when the environment is dark, or at foggy or stormy day time when the visibility is low.

The illuminating device may be provided at the front and/or the back of the coat or the jacket. The illuminating device gives out light signals to others approaching the area where the ground man or the flag man is working. This provides the ground man or the flag man with a safety device to be used in a rather unsafe working environment.

The clothing may be a vest worn by a policeman or a fireman performing duty at night time when the environment is dim or dark, or at a fire scene filled with smoke. The illuminating device may be provided at the front and/or the back of the vest. The illuminating device sends out light signals to other in the area where the policeman or the fireman is working. This allows the policeman or the fireman to be easily observed and identified.

The clothing may also be a pant worn by a cyclist or a jogger travelling or exercising at night time. The illuminating device provided along the outer leg of the pant sends out moving light signals to motorists on the road where the cyclist or the jogger is around. This prevents possible accident on the road.

The illuminating device to be mounted on the clothing may simply give out a bright white light, or it may give out a coloured light. The illuminating device may spell out a word or a sign such as "POLICE", or "FIRST AID", or "RESCUE", etc The illuminating device may also show the name or logo of a company or an organization, or an advertisement.

Furthermore, the illuminating device may be custom designed for special events and needs.

Figure 1:
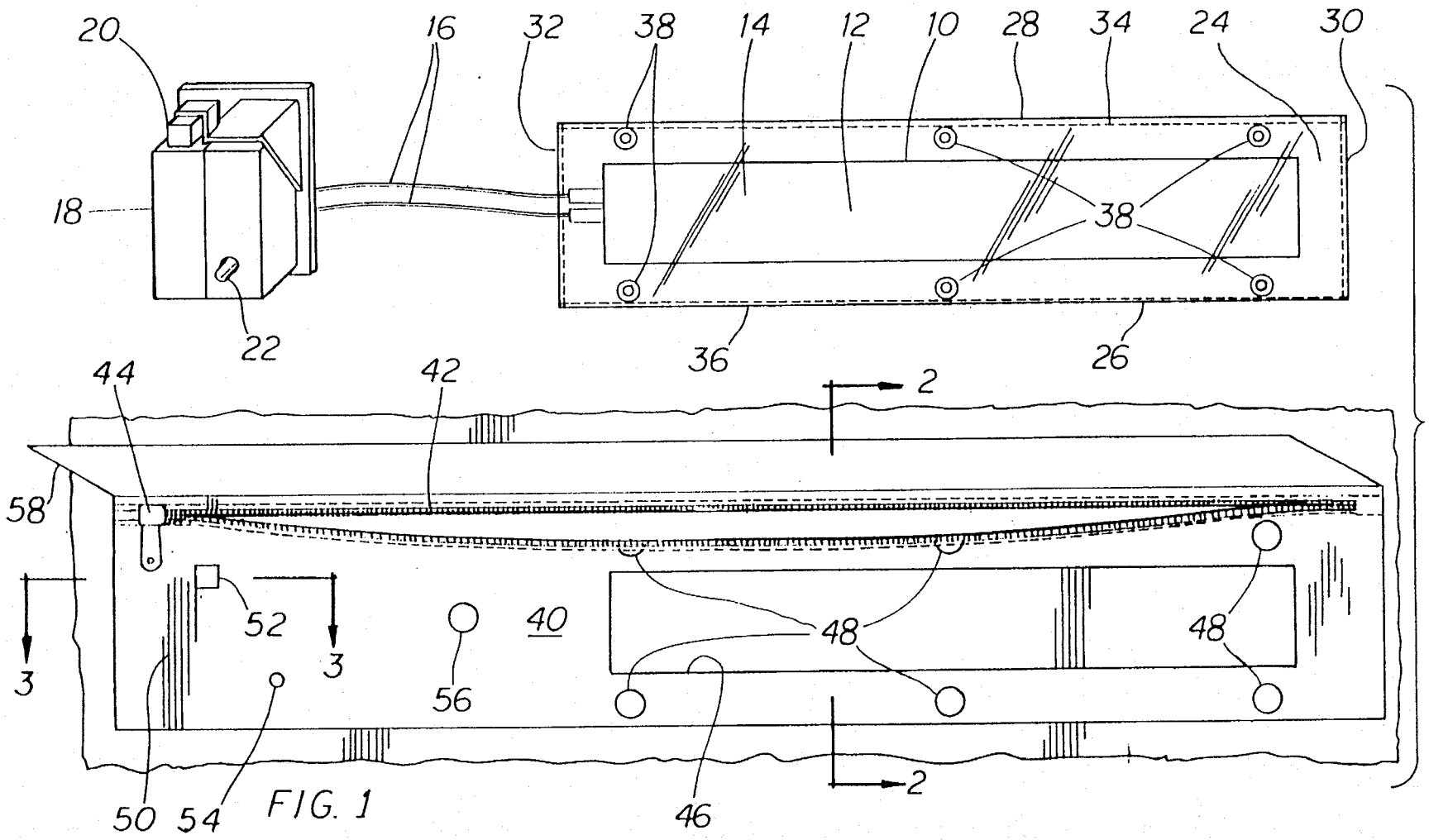
FIG. 1 is an exploded front view of a pouch adapted to receive therein an illuminating panel according to a first embodiment of the present invention.

Referring now to the drawings in which like reference numerals represent like parts throughout the drawings, FIGS. 1 to 5 show a first embodiment of the present invention. In FIG. 1, an illuminating panel is indicated by reference numeral 10. This kind of illuminating panel is commercially available in different forms and shapes. The illuminating panel generates a bright light when electricity passes therethrough. The panel is usually thin and flexible.

In the present embodiment, the illuminating panel 10 is rectangular in shape having a front surface 12 and a rear surface 14. The illuminating panel 10 is electrically connected to a power source, such as a battery (not shown), by means of electric wires 16. The battery is mounted within a casing 18. A switch 20 is provided on a front surface of the casing 18 for controlling the power supply from the power source. The illuminating panel 10 becomes illuminated when the power is turned on.

When the power is turned on, the illumination may stay on, or it may turn on and off at short intervals thereby creating a flashing effect. The mode of illumination can be controlled by electric circuits on a circuit board (not shown) provided within the casing 18.

A light signal 22 is provided to indicate the condition of the power supply source as well as the mode of illumination of the illuminating panel 10. The light signal 22 is lit when the power source is turned on and the illuminating panel 10 is illuminating. The light signal 22 is off when the power supply is terminated and the illuminating panel 10 is not illuminating. The light signal 22 may be flashing at the same time when the illumination of the illuminating panel 10 is on and off at short intervals, as controlled by the electric circuits.

Figure 2:
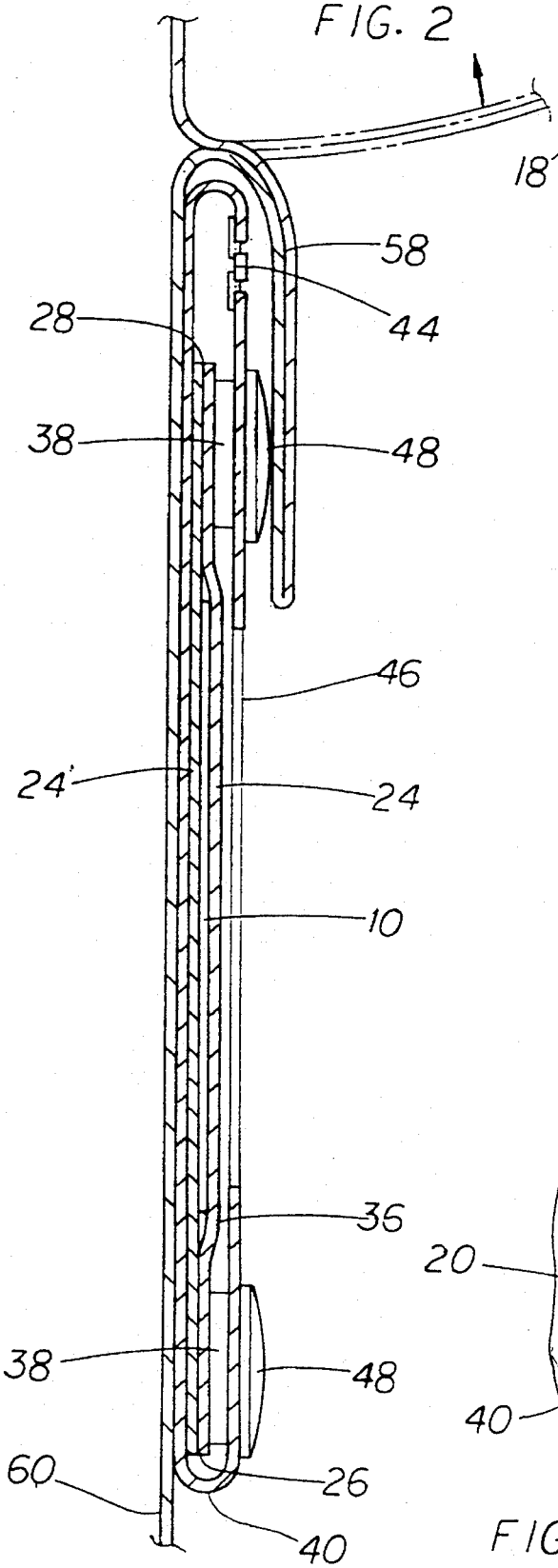
FIG. 2 is a sectional view taken along line 2—2 of FIG. 1 showing the illuminating panel being disposed in the pouch.

The illuminating panel 10 is covered on the front surface 12 by a front cover sheet 24 and on the rear surface 14 by a rear cover sheet 24', as best illustrated in FIG. 2 The front and rear cover sheets 24, 24' are employed to cover up and protect the illuminating panel 10 from scratch, dust, and moisture. The front and rear cover sheets 24, 24' are preferably made of thin, flexible plastic material. At least the front cover sheet 24 is transparent in order to permit light generating from the illuminating panel 10 to pass through. According to the present embodiment, the front and rear cover sheets 24, 24' are rectangular in shape and are of the same dimension. Their respective edges 26, 28, 30, and 32 are sewn together by stitches 34 forming an enclosed sleeve 36 in which the illuminating panel 10 is received.

The rear cover sheet 24' may be in the form of a scrim made of fibrous non-plastic material for supporting the illuminating panel 10.

Snap fasteners 38 with sockets are secured on the sleeve 36 along the longitudinal edges 26, 28 by conventional means. These snap fasteners 38 are the first halves of the conventional ball-and-socket snap fasteners. In the present embodiment, six snap fasteners 38 with sockets are provided, three on each of the two longitudinal edges 26 and 28. As best illustrated in FIG. 2, the snap fasteners 38 are secured on the outer surface of the front cover sheet 24 and are adapted to couple with corresponding second halves of the snap fasteners to be described later. According to the present embodiment, the snap fastener 38 serve to hold the illuminating panel 10 in position within the enclosed sleeves 36.

The illuminated panel 10 and the power source casing 18 are adapted to be received in a pocket or a pouch designated generally by reference numeral 40. According to the present embodiment, the pouch 40 is rectangular in shape and is preferably made of a waterproof fabric material. The pouch 40 has an opening 42 provided along a longitudinal edge of the pouch 40. The power source casing 18 and the illuminating panel 10 are adapted to be inserted into the pouch 40 through the opening 42. A slide fastener 44, or any suitable fastener, is employed to open and close the pouch 40.

A window opening 46 is provided on a front surface of the pouch 40. The window opening 46 is rectangular in shape. The dimensions of the window opening 46 is preferably the same as the dimension of the illuminating panel 10.

Six snap fasteners 48 with balls are secured on the front surface of the pouch 40 in corresponding positions with the six snap fasteners 38 with sockets provided on the sleeve 36 such that the illuminating panel 10 is in registration with the window opening 46. When the electric power is turned on, the light signal generated from the illuminating panel 10 is able to show through the window opening 46.

Figure 3:
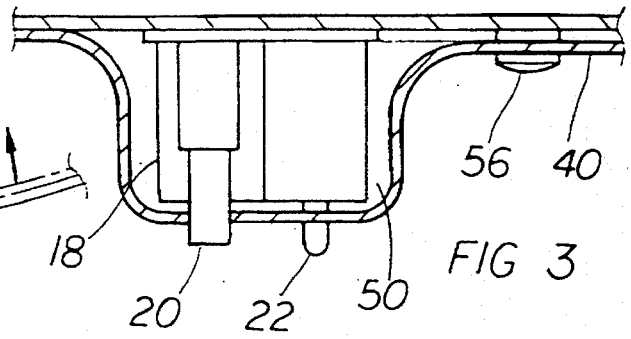
FIG. 3 is a sectional view taken along line 3—3 of FIG. 1 showing a compartment at one end of the pouch and a power source disposed therein.

As illustrated in FIG. 3, one end of the pouch 40 has an enlarged compartment 50 for receiving therein the power source casing 18. The front surface of the compartment 50 has an opening 52 for the switch 20 and an opening 54 for the light signal 22.

A further snap fastener 56, or any suitable fastening means, is provided on the pouch 40 for holding the power source casing 18 in position within the compartment 50.

A flap 58 is preferably provided on the pouch 40 and is adapted to flip over and cover up the slide fastener 44 on the pouch 40. The flap 58 is made of waterproof fabric material to further protect the illuminating panel 10 from dust and moisture.

As illustrated in FIG. 2, the pocket or pouch 40 is adapted to be mounted on a clothing 60. The pouch 40 may be fixedly secured to the clothing 60 by stitching. Preferably, the pouch 40 is detachably mounted onto the clothing 60 by hook and loop pile fasteners, or snap fasteners, or any other suitable fastening means. This allows possible mounting of the pouch 40 with the illuminating panel 10 to any desired position on any kind of clothing.

Figure 5:
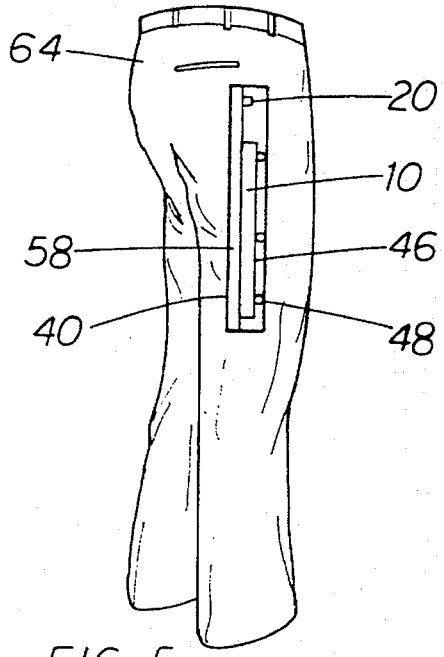
FIG. 5 illustrates the mounting of the pouch and the illuminating panel on a pant.
Figure 4:
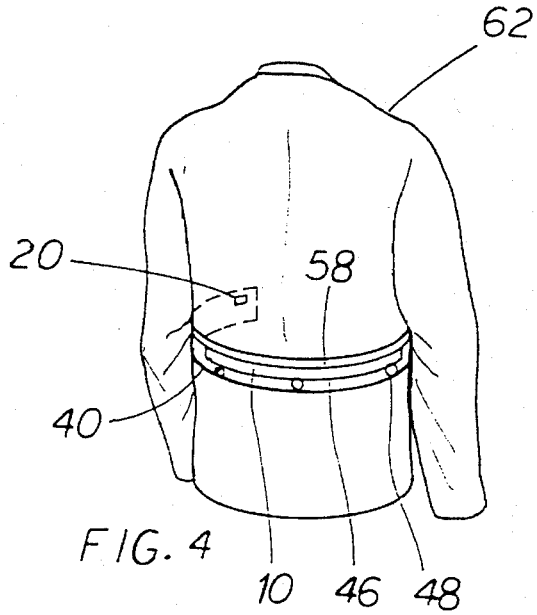
FIG. 4 illustrates the mounting of the pouch and the illuminating panel on a jacket.

FIGS. 4 and 5 illustrate the mounting of the pouch 40 and the illuminating panel 10 on a jacket and a pant respectively.

As shown in FIG. 4, the pouch 40 is mounted on a coat or a jacket 62. The pouch 40 extends substantially across the back of the jacket 62, around one side and to a front part of the jacket 62. The pouch 40 is so positioned that the window opening 46 extends across the back of the jacket 62 and the power control compartment 50 is located at the front of the jacket 62.

The illuminating panel 10 and the sleeve 36, both being flexible, are adapted to be inserted into the pouch 40 sideways and are held in a predetermined position by snapping the snap fasteners 38, 48 together such that the illuminating panel 10 is in registration with the window opening 46. Although it is shown in FIG. 4 that the illuminating panel 10 is positioned across a lower part of the jacket 62, it is understood that the illuminating panel 10 may be located across an upper part of the jacket 62, or along the sleeves of the jacket 62, as desired or required in different circumstances.

The power source casing 18 is received in the compartment 50 and is held in position by the snap fastener 56 such that the switch 20 and the light signal 22 are in registration with the switch opening 52 and the light signal opening 54 respectively.

The electric wires 16 connecting the illuminating panel 10 and the power source casing 18 are extending along one side of the jacket 62 within the pouch 40.

The switch 20 is located at the front of the jacket 62 for easy access by a user. The light signal 22 is also located at the front of the jacket 62 so that the user can be assured of the illumination condition of the illuminating panel 10 located at the back of the jacket 62 by the indication of the light signal 22.

As shown in FIG. 5, the pouch 40 is mounted on a pant 64 and is extending along the outer leg of the pant 64.

The power control compartment 50 of the pouch 40 is located near the waistband of the pant 64 for easy access by the user. Although it is shown in FIG. 5 that the illuminating panel 10 is provided along one side of the pant 64, it is appreciated that an illuminating panel 10 can be provided along both sides of the pant 64 for better illumination results.

Figure 6:
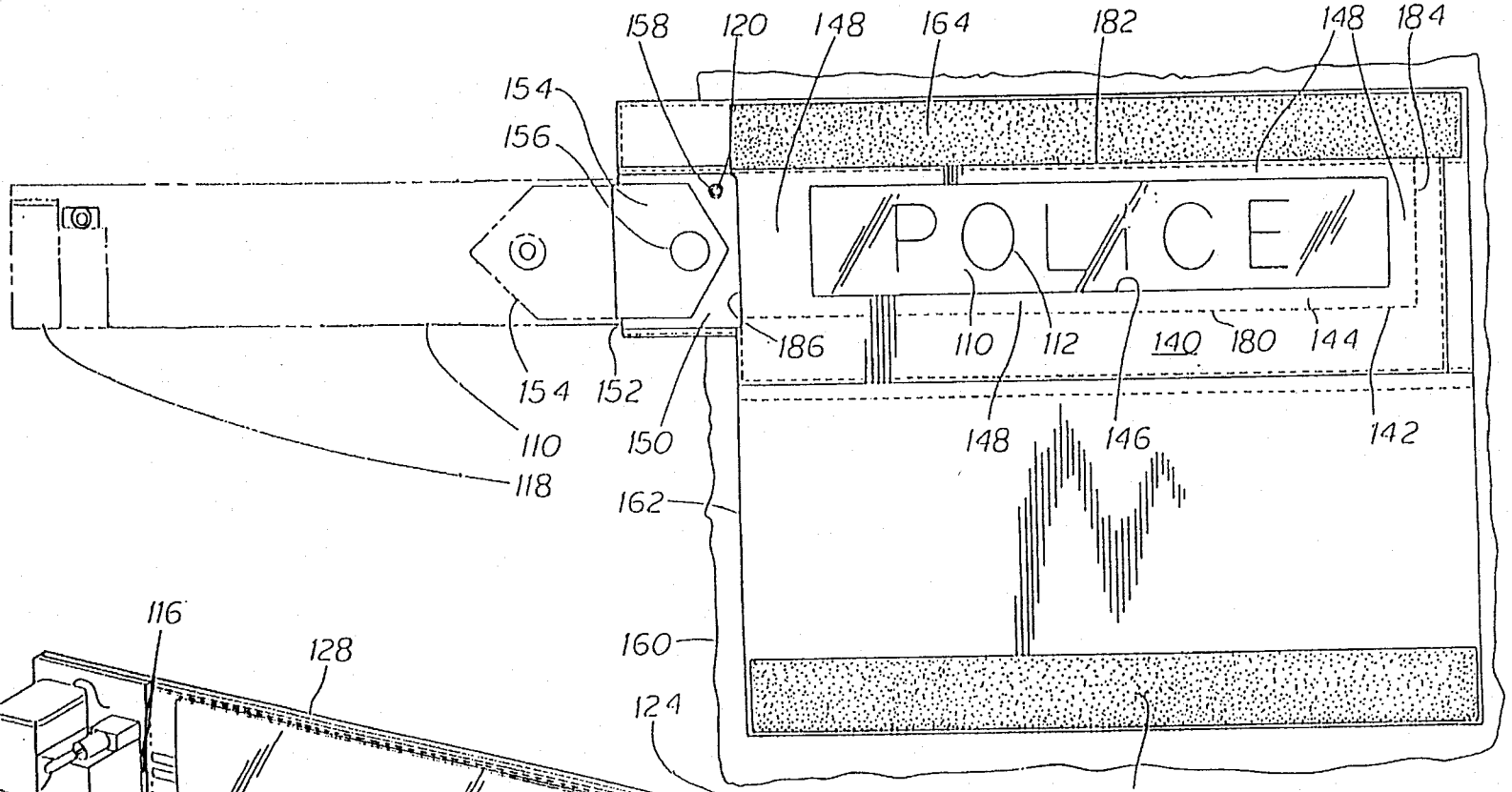
FIG. 6 is a front view of a pouch with an illuminating panel according to a second embodiment of the present invention.
Figure 7:
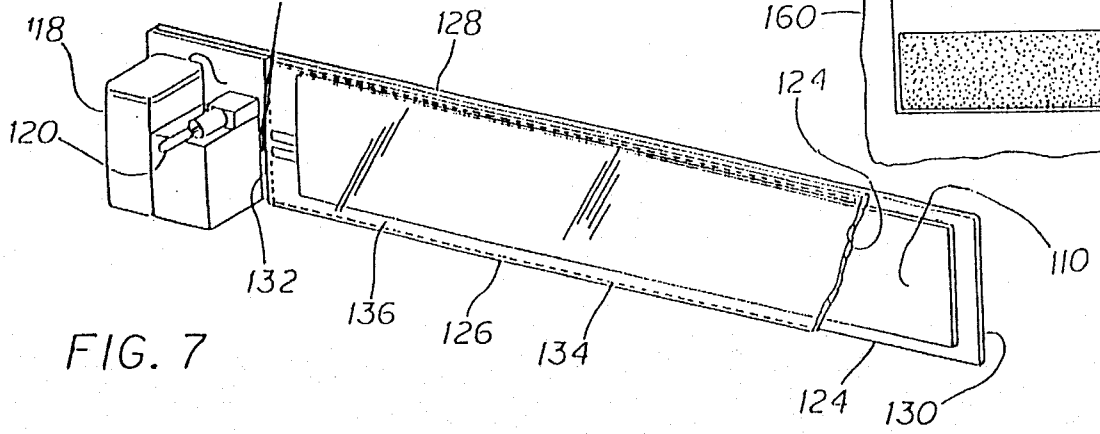
FIG. 7 is a perspective view of the illuminating panel of FIG. 6.
Figure 8:
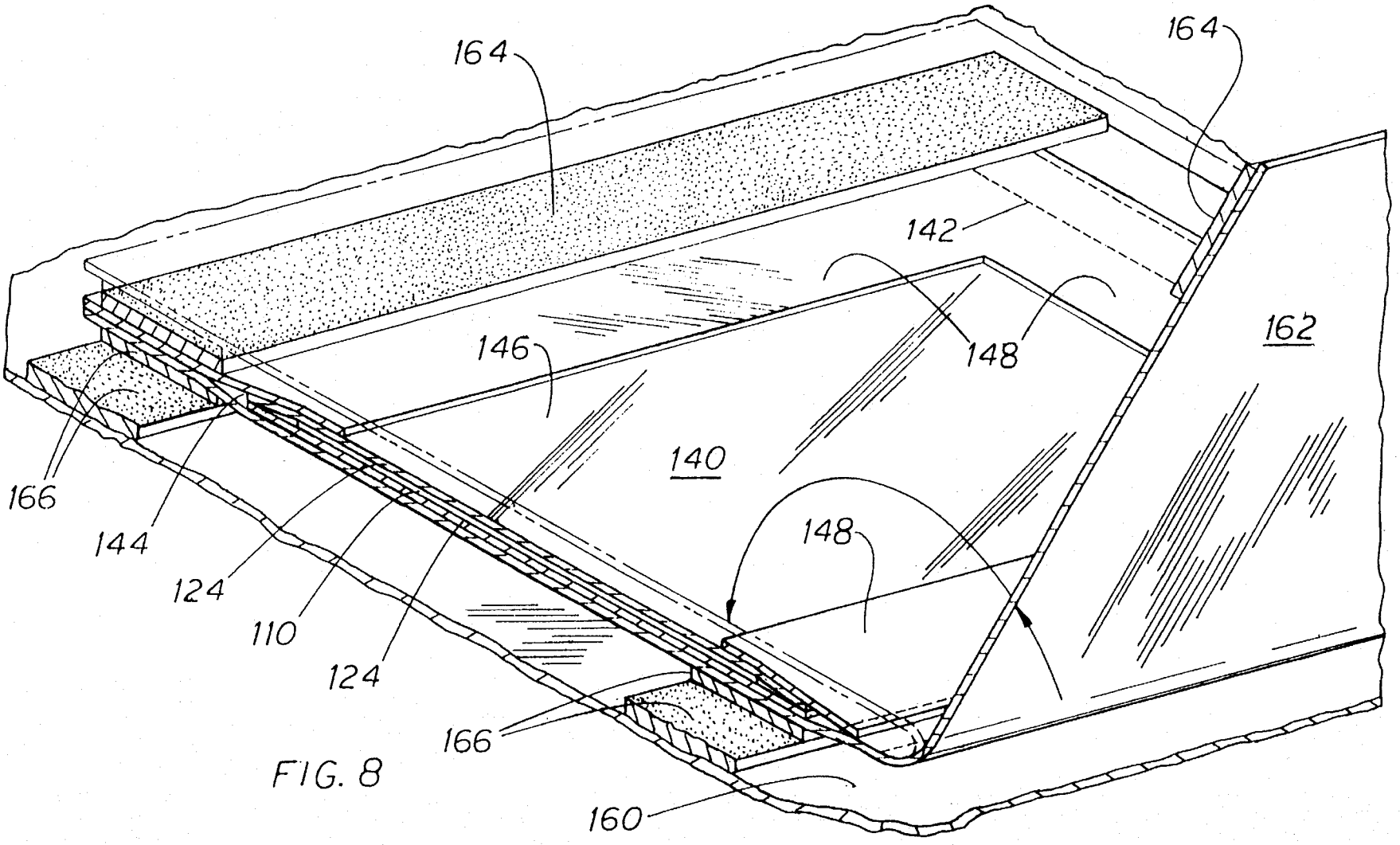
FIG. 8 is a cross sectional view of the pouch and the illuminating panel of FIG. 6.

FIGS. 6, 7 and 8 show a second embodiment of the present invention.

As shown in FIGS. 6 and 7, an illuminating panel is indicated by reference numeral 110. The illuminating panel 110 is adapted to generates a bright light when electricity passes therethrough. In this embodiment, a sign or an indicia 112 is provided on the front surface of the illuminating panel 110. The panel is usually thin and flexible.

In the second embodiment, the illuminating panel 110 is also rectangular in shape. The illuminating panel 110 is electrically connected to a power source, such as a battery (not shown), by means of electric wires 116. The battery is mounted within a casing 118. A switch 120 is provided on the casing 118 for controlling the power supply from the power source. The illuminating panel 110 becomes illuminated when the power is turned on.

The illuminating panel 110 is covered on the front surface by a front cover sheet 124 and on the rear surface by a rear cover sheet 124'. The front and rear cover sheets 124, 124' are used to cover up and protect the illuminating panel 110 from scratch, dust, and moisture. The front cover sheet 124 is made of transparent plastic material in order to permit light generating from the illuminating panel 110 to pass therethrough. According to the preferred embodiment, the rear cover sheet 124' is in the form of a semi-rigid scrim which serves to support and hold the illuminating panel 110 in a semi-rigid condition.

The front cover sheet 124 is sewn onto the rear cover sheet 124' along the edges 126, 128, 130, and 132 by stitches 134 thereby forming an enclosed sleeve 136 in which the illuminating panel 110 is received.

According to the present embodiment the rear cover sheet 124' extends outwardly from the edge 132 of the sleeve 136. The power source casing 118 is adapted to be fixedly mounted on the extended rear cover sheet 124'.

The illuminated panel 110 and the power source casing 118 are adapted to be received in a pocket or a pouch designated generally by reference numeral 140. The pouch 140 is rectangular in shape and is preferably made of a waterproof fabric material. Stitchings 142 are provided on the pouch 140 and define a sleeve 144 for receiving therein the illuminating panel 110. The sleeve 144 so defined has three closed sides 180, 182, 184 and an open end 186.

A window opening 146 is provided on a front surface of the sleeve 144. The window opening 146 is rectangular in shape. The dimensions of the window opening 146 is preferably the same as the dimension of the illuminating panel 110. The edge portions 148 of the sleeve 144 around the window opening 146 serve to hold the illuminating panel 110 in position-within the sleeve 144.

Extending from the open end 186 of the sleeve 144 is a compartment 150. The compartment 150, being also made of waterproof fabric material, is adapted to receive therein the power source casing 118. An opening 152 is provided on the compartment 150. The illuminating panel 110 and the power source casing 118, both being mounted on semi-rigid rear cover sheet 124', are adapted to be easily inserted into and removed from the sleeve 144 and the compartment 150 endwise through the opening 152, as shown by phantom line in FIG. 6. A cover 154 is employed to close the compartment 150 and fastened thereto by a snap fastener 156, or any suitable fastening means.

The front surface of the compartment 150 has an opening 158 for the switch 120.

A flap 162 is provided to flip over and cover up the pouch 140, as illustrated in FIG. 8. The flap 162 is made of waterproof fabric material to further protect the illuminating panel 10 from scratch, dust and moisture.

A hook and loop pile fastener 164 is used to hold the flap 162 against the pouch 140.

The pouch 140 is adapted to be mounted on a clothing 160. The pouch 140 may be fixedly secured to the clothing 160 by stitching. Preferably, the pouch 140 is detachably mounted onto the clothing 160 by hook and loop pile fasteners 166, or snap fasteners, or any other suitable fastening means. This allows possible mounting of the pouch 140 with the illuminating panel 110 to any desired position on any kind of clothing.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A clothing with illuminating device comprising:

an article of clothing;

illuminating means;

sleeve means for covering and supporting said illuminating means;

means for holding said illuminating means in position within said sleeve means;

power source means electrically connected to said illuminating means by wire means;

switch means connected to the power source means for controlling the power supply from said power source means;

pouch means with an opening receiving therein said power source means and said illuminating means, said pouch means configured to be detachably mounted to said clothing;

means for closing said opening of said pouch means;

means for holding said power source means and said sleeve means in position within said pouch means;

window opening means provided on said pouch means for permitting light signal generating from said illuminating means to pass therethrough when said power source means is being turned on, and, light signal means associated with said pouch means and connecting with the illuminating means for indicating the illumination condition of said illuminating means.

2. A clothing with illuminating device as claimed in claim 1 wherein said sleeve means is a first cover sheet provided on a front surface of said illuminating means and a second cover sheet provided on a rear surface of said illuminating means, said first and second cover sheets being sewn together along their respective edges.

3. A clothing with illuminating device as claimed in claim 2 wherein said first and second cover sheets are made of a flexible transparent plastic material.

4. A clothing with illuminating device as claimed in claim 2 wherein said first cover sheet is made of a flexible ransparent plastic material whereas said second cover sheet is a scrim supporting said illuminating means in a semi-rigid condition.

5. A clothing with illuminating device as claimed in claim 1 wherein one end of said pouch means is provided with an enlarged compartment receiving therein said power source means.

6. A clothing with illuminating device as claimed in claim 5 wherein said opening of said pouch means is provided on said enlarged compartment at said end of said pouch means, whereby said illuminating means and said power source means are configured to be inserted into and removed from said end of said pouch means.

7. A clothing with illuminating device as claimed in claim 1 wherein said opening of said pouch means is provided along a longitudinal side of said pouch means.

8. A clothing with illuminating device as claimed in claim 1 wherein said pouch means is configured to be mounted across said clothing being worn on an upper part of a body of a user and defining a front and a back such that the illuminating means is located at the back whereas the switch means is located at the front.

9. A clothing with illuminating device as claimed in claim 1 wherein said pouch means is configured to be mounted along said clothing comprising an outer leg of a pant.

10. A clothing with illuminating device as claimed in claim 1 wherein said illuminating means is an illuminating panel.

11. An illuminating pouch for use in association with an article of clothing comprising:

pouch means configured to be detachably mounted to said clothing, said pouch means having an opening;

illuminating means being received in said pouch means;

sleeve means for covering and supporting said illuminating means;

means for holding said illuminating means in position within said sleeve means;

power source means being received in said pouch means and electrically connected to said illuminating means by wire means;

switch means connected to the power source means for controlling the power supply from said power source means;

means for closing said opening of said pouch means;

means for holding said power source means and said sleeve means in position within said pouch means;

window opening means provided on said pouch means for permitting light signal generating from said illuminating means to pass therethrough when said power source means is being turned on, and, light signal means associated with said pouch means and connected with the illuminating means for indicating the illumination condition of said illuminating means.

12. An illuminating pouch for use in association with an article of clothing as claimed in claim 11 wherein said sleeve means is a first cover sheet provided on a front surface of said illuminating means and a second cover sheet provided on a rear surface of said illuminating means, said first and second cover sheets being sewn together along their respective edges.

13. An illuminating pouch for use in association with an article of clothing as claimed in claim 12 wherein said first cover sheet is made of a flexible transparent plastic material whereas said second cover sheet is a scrim supporting said illuminating means in a semi-rigid condition.

14. An illuminating pouch for use in association with an article of clothing as claimed in claim 11 wherein one end of said pouch means is provided with an enlarged compartment receiving therein said power source means.

15. An illuminating pouch for use in association with an article of clothing as claimed in claim 14 wherein said opening of said pouch means is provided on said enlarged compartment at said end of said pouch means, whereby said illuminating means and said power source means are configured to be inserted into and removed from said end of said pouch means.

16. An illuminating pouch for use in association with an article of clothing as claimed in claim 12 wherein said opening of said pouch means is provided along a longitudinal side of said pouch means.

* * * * *